United States Patent [19]

Nanyoshi et al.

[11] Patent Number: 4,977,876

[45] Date of Patent: Dec. 18, 1990

[54] FUEL INJECTION CONTROL SYSTEM FOR INTERNAL COMBUSTION ENGINE WITH FUEL CUT-OFF CONTROL AT HIGH ENGINE SPEED RANGE SUPPRESSIVE OF RECOVERY SHOCK UPON FUELS RESUMPTION

[75] Inventors: Yasutoshi Nanyoshi, Yokosuka; Sadao Takase, Yokohama, both of Japan

[73] Assignee: Nissan Motor Company, Ltd., Yokohama, Japan

[21] Appl. No.: 506,511

[22] Filed: Apr. 5, 1990

Related U.S. Application Data

[63] Continuation of Ser. No. 165,654, Mar. 8, 1988, abandoned.

[51] Int. Cl.[5] ..... F02D 33/00

[52] U.S. Cl. ..... 123/333

[58] Field of Search ..... 123/333, 319, 322, 325, 123/326, 332, 340, 630, 165, 654, 351

[56] References Cited

U.S. PATENT DOCUMENTS

| | | | |
|---|---|---|---|
| 3,835,825 | 9/1974 | Baxendale et al. | 123/333 |
| 3,866,584 | 2/1975 | Bigalke et al. | 123/333 |
| 4,434,759 | 3/1984 | Iezuka et al. | 123/333 |
| 4,506,638 | 3/1985 | Horii et al. | 123/333 |
| 4,598,679 | 7/1986 | Ohkumo et al. | 123/333 |
| 4,638,781 | 1/1987 | Shiki et al. | 123/333 |
| 4,674,458 | 6/1987 | Mori | 123/333 |
| 4,700,673 | 10/1987 | Denz | 123/333 |
| 4,736,719 | 4/1988 | Franica et al. | 123/333 |

*Primary Examiner*—Raymond A. Nelli

*Attorney, Agent, or Firm*—Pennie & Edmonds

[57] ABSTRACT

A fuel injection control system performs fuel cut-off operation intermittently so that engine output torque may not fluctuate at significant level to cause jerking at the transition from fuel injecting state to fuel to fuel cut-off state and at fuel resumption after fuel cut-off. Intermittnetly cutting off the fuel delivery for the engine cylinders, engine output torque drop at the fuel injecting state and fuel cut-off state can be reduced for reducing magnitude of jerking.

23 Claims, 13 Drawing Sheets

| NUMBER OF CYLINDERS TO PERFORM FUEL CUT | CYLINDER # TO CUT | | | | | |
|---|---|---|---|---|---|---|
| 0 | 1 | 2 | 3 | 4 | 5 | 6 |
| 1 | 1 | 2 | 3 | 4 | 5 | 6 |
| 2 | 1 | 2 | 3 | 4 | 5 | 6 |
| 3 | 1 | 2 | 3 | 4 | 5 | 6 |
| 4 | 1 | 2 | 3 | 4 | 5 | 6 |
| 5 | 1 | 2 | 3 | 4 | 5 | 6 |
| 6 | 1 | 2 | 3 | 4 | 5 | 6 |

| NUMBER OF CYLINDERS TO PERFORM FUEL CUT | CYLINDER # TO CUT | | | | | |
|---|---|---|---|---|---|---|
| 0 | 1 | 2 | 3 | 4 | 5 | 6 |
| 1 | ① | 2 | 3 | 4 | 5 | 6 |
| 2 | ① | ② | 3 | 4 | 5 | 6 |
| 3 | ① | ② | ③ | 4 | 5 | 6 |
| 4 | ① | ② | ③ | ④ | 5 | 6 |
| 5 | ① | ② | ③ | ④ | ⑤ | 6 |
| 6 | ① | ② | ③ | ④ | ⑤ | ⑥ |

FUEL INJECTION CONTROL SYSTEM FOR INTERNAL COMBUSTION ENGINE WITH FUEL CUT-OFF CONTROL AT HIGH ENGINE SPEED RANGE SUPPRESSIVE OF RECOVERY SHOCK UPON FUELS RESUMPTION

This is a continuation of application Ser. No. 165,654, filed March 3, 1988, now abandoned.

BACKGROUND OF THE INVENTION

1. Field of the Invention

The present invention relates to a fuel injection control system for an internal combustion engine. More specifically, the invention relates to a fuel injection control with fuel cut-off control in a high engine speed range for preventing discomfortable shock caused due to variation of torque upon fuel resumption and for preventing a catalytic converter in an exhaust system from over-heating.

2. Description of the Background Art

It is well known technique for performing fuel cut-off operation at high engine speed range for preventing the engine from being further accelerated to be damaged due to excessive speed. For example, the Japanese Patent First (unexamined) Publication (Tokkai) Showa 61-55323 discloses a fuel cut-off technique for protecting the engine from being driven at excessively high speed over a revolution limit. In the disclosed system, engine cylinders are divided into two groups. i.e. first and second groups for performing fuel cut-off operation at two stages. Namely, when the engine speed is relatively low, fuel cut-off operation is performed only for the first group of engine cylinders. On the other hand, when the engine speed is substantially high. fuel cut-off is performed for all of the engine cylinders. Such system is effective in reducing shock due to output torque flactuation upon fuel resumption and to reduce magnitude of hunting is engine speed.

Though the system disclosed above can avoid significant shock upon fuel recovery or resumption, it still cause smaller magnitude torque fluctuation to cause still noticable shock. Such shock will degrade riding comfort and drivability especially at the engine driving condition where fuel cut-off and resumption are repeated.

Furthermore, in the condition where the fuel cut-off is performed for only first group of engine cylinders, relatively rich air/fuel mixture is introduced to the second group of engine cylinder. Therefore, larger amount of HC and CO is generated in the second group of cylinders. The HC and CO contained in the exhaust gas from the second group of cylinders causes raising of the temperature of catalytic converter which will cause burn out of the catalytic converter in the worst case.

SUMMARY OF THE INVENTION

Therefore, it is an object of the invention to provide a fuel injection control system for an internal combustion engine which performs fuel cut-off at high engine speed range which can suppress recovery shock upon fuel recovery and can prevent catalytic converter from over-heating.

In order to accomplish the aforementioned and other objects, a fuel injection control system. according to the present invention, performs fuel cut-off operation intermittently so that engine output torque may not fluctuate at significant level to cause jerking at the transition from fuel injecting state to fuel to fuel cut-off state and at fuel resumption after fuel cut-off. Intermittently cutting off the fuel delivery for the engine cylinders, engine output torque drop at the fuel injecting state and fuel cut-off state can be reduced for reducing magnitude of jerking.

According to one aspect of the invention, a fuel injection control system for an internal combustion engine, comprises a fuel injection system including a fuel injection valve for delivering a controlled amount of fuel at a controlled timing, a sensor means for monitoring engine driving parameters including an engine revolution speed, and a controller, associated with the fuel injection system for controlling fuel delivery amount and fuel injection timing based on the engine driving parameters monitored by the sensor means, the controller being responsive to the engine revolution speed higher than a predetermined fuel cut speed to initiate fuel cut-off operation to intermittently block fuel delivery through the fuel injection valve.

According to another aspect of the invention, a fuel injection control system for an internal combustion engine, comprises a fuel injection system including a fuel injection valve for delivering a controlled amount of fuel at a controlled timing, a sensor means for monitoring engine driving parameters including an engine revolution speed, and a controller, associated with the fuel injection system for controlling fuel delivery amount and fuel injection timing based on the engine driving parameters monitored by the sensor means, the controller being responsive to the engine revolution speed higher than a predetermined value to initiate fuel cut-off operation, the controller deriving a period of a fuel cut cycle, which fuel cut cycle period being variable depending upon the excess magnitude of the engine speed over the predetermined fuel cut speed, the fuel cut cycle including a fuel cut-off period and fuel resuming period, and the controller repeats fuel cut cycles until engine speed is decelerated below a predetermined fuel resuming speed.

Preferably, the controller orders fuel cut-off for the fuel cut-off period and subsequently orders fuel resumption for the fuel resuming period after the fuel cut period expires. In this case, the controller orders fuel cut-off at a timing corresponding to at the end of an intake valve open period after fuel cut-off condition is statisfied and orders fuel resumption at a timing corresponding to at the end of an intake valve open period after fuel resume condition is satisfied.

According to a further aspect of the invention, a fuel injection control system for an internal combustion engine, comprises a fuel injection system including a fuel injection valve for delivering a controlled amount of fuel at a controlled timing, a sensor means for monitoring engine driving parameters including an engine revolution speed, and a controller, associated with the fuel injection system for controlling fuel delivery amount and fuel injection timing based on the engine driving parameters monitored by the sensor means, the controller being responsive to the engine revolution speed higher than a predetermined value to initiate fuel cut-off operation, the controller deriving number of engine cylinders to block fuel delivery based on the excess magnitude of engine speed over the predetermined fuel cut speed for performing fuel cut-off operation for the determined number of engine cylinders and for maintaining fuel injection for remaining cylinders.

In the preferred construction, the controller orders fuel cut-off at a timing corresponding to at the end of an intake valve open period after fuel cut-off condition is satisfied and orders fuel resumption at a timing corresponding to at the end of an intake valve open period after fuel resume condition is satisfied. The controller identifies engine cylinders to perform fuel cut-off based on the number of engine cylinders to perform fuel cut-off.

BRIEF DESCRIPTION OF THE DRAWINGS:

In the drawings.

FIG. is a schematic block diagram of the preferred embodiment of a fuel injection control system for an internal combustion engine, according to the invention.

DESCRIPTION OF THE PREFERRED EMBODIMENT

Figure 1:
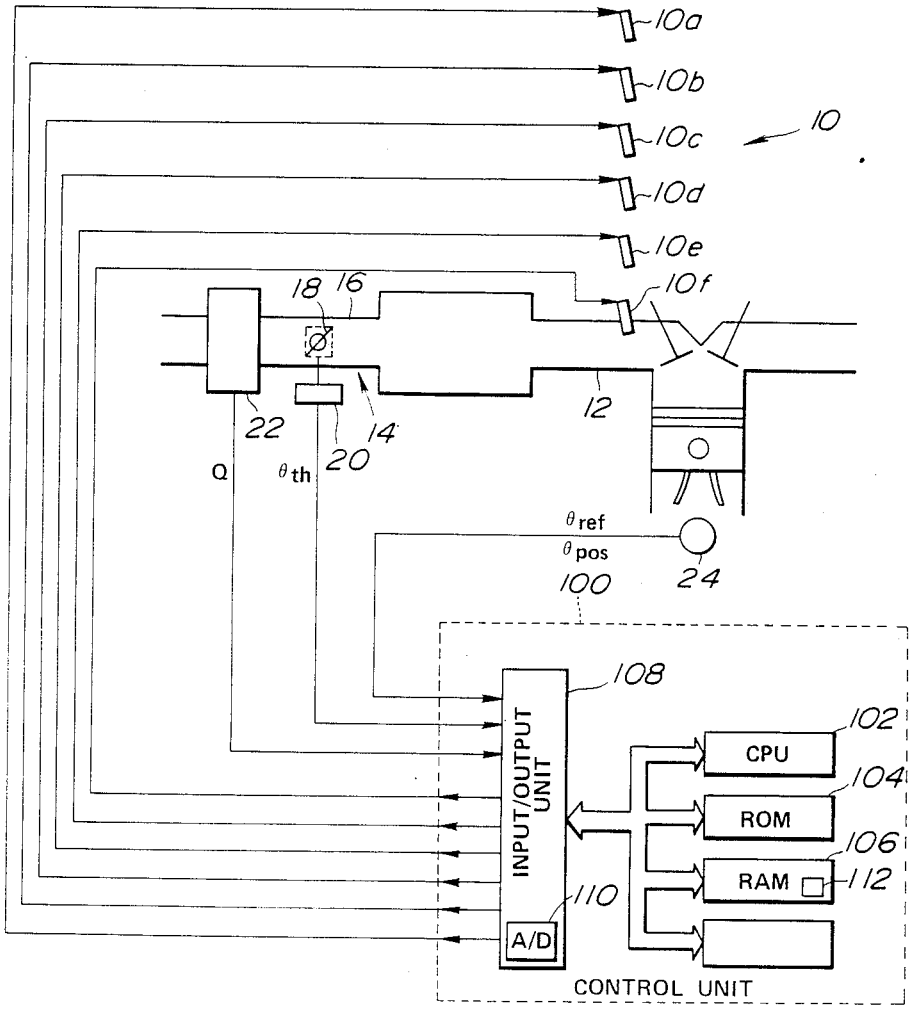

Referring now to the drawings, particularly to FIG. 1 the preferred embodiment of a fuel injection control system, according to the present invention.

Since the shown embodiment of the fuel a injection control system includes a plurality of fuel injection valves 10. Each fuel injection valve 10 is inserted into each of branch passage of an intake manifold 12 of an air induction system 14. As is well known, the air induction system 14 includes a throttle chamber 16, in which is disposed a throttle valve 18. A throttle angle sensor 20 is associated with the throttle valve 18 to monitor the angular position of the latter to output a throttle angle position indicative signal $\theta_{th}$. An air flow meter 22 is disposed in the air induction system 14 upstream of the throttle chamber 16 in order to monitor an intake air flow rate Q and produces an intake air flow rate indicative signal $S_Q$.

The throttle angle sensor 20 and the air flow meter 22 are connected to a control unit 100 which comprises a microprocessor including CPU 102, ROM 104, RAM 106 and an input/output unit 108. RAM 106 may includes a non-volataile memory block 112 so as to store data which should be held even after the power supply ceases. To the control unit 100, a crank angle sensor 24 is also connected. The crank angle sensor 24 is designed to monitor a crankshaft angular position to produce a crank reference signal $\theta_{ref}$ at every predetermined angular position, i.e. 70° before top-dead-center (BTDC). and a crank position signal $\theta_{pos}$ every predetermined angular displacement, i.e. 1° or 2°, of the crankshaft.

In order to perform sequential injection control, the control unit 100 has to discriminate cylinder number of the engine cylinder approaching the induction TDC. Therefore, the crank angle sensor 24 is so designed as to produce the crank reference signal $\theta_{ref}$ having different pulse width than that of other crank reference signals $\theta_{ref}$ at a crankshaft angular position corresponding to 70° BTDC of specified one of engine cylinder, e.g. No. 1 cylinder.

Though it is not essential and thus does not illustrated in FIG. 1 the control unit may also be connected to additional sensors, such as an engine coolant temperature sensor, an idle switch, a starter switch, an oxygen ($O_2$) sensor and so forth for receiving a fuel injection amount correction parameter. Therefore, though the following discussion concerning derivation of the fuel injection amount will be discussed in terms of limited fuel injection control parameters, it should be appreciated that any fuel injection amount correction on the basis of additional fuel injection correction parameters are to be performed if necessary. Therefore, process of derivation of the fuel injection amount and the fuel injection pulse width should not be appreciated as to be essential feature of the invention.

Figure 2:
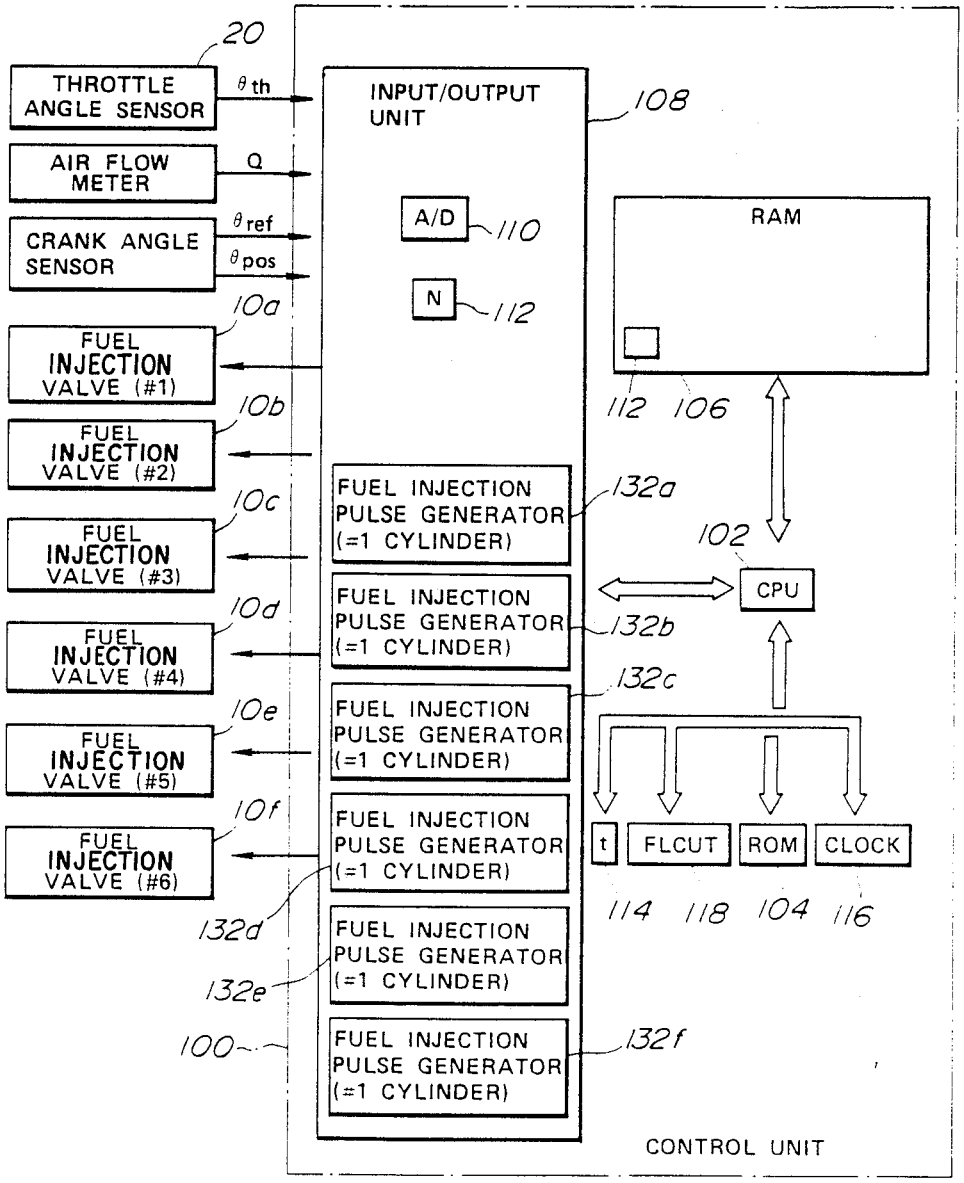
FIG. 2 is a schematic block diagram of the preferred construction of a fuel injection control circuit to be employed in the preferred embodiment of the fuel injection control system of FIG. 1.

FIG. 2 shows the detailed construction of the control unit 100 as associated with the throttle angle sensor 20, air flow meter 22 and crank angle sensor 24. Since the throttle angle sensor 20 and air flow meter 22 inputs the throttle angle position indicative signal $\theta_{th}$ and intake air flow rate indicative signal $S_Q$ in analog form, a analog-to-digital (A/D) converter 110 is provided in the input/output unit 108 for converting the analog form throttle angle position indicative signal $\theta_{th}$ and intake air flow rate indicative signal $S_Q$ into digital processor applicable digital signals. The input/output unit 108 also includes an engine speed counter 112 which derives engine speed data N on the basis of one of crank reference signal $\theta_{ref}$ and crank position signal $\theta_{pos}$. As is well known, in case the engine speed data N is to be derived on the basis of the crank reference signal $\theta_{ref}$ an interval of occurrences of crank reference signal $\theta_{ref}$ is measured to derive the engine speed data based on the measured interval. On the other hand, in case that the engine speed data N is to be derived on the basis of the crank position signal $\theta_{pos}$, of the crank position signal $\theta_{pos}$ is counted within a given period or elapsed time for receiving a given number of crank position signal $\theta_{pos}$ is measured. Based on the count of the crank position signal $\theta_{pos}$ or the measured period, the engine speed data N is derived.

The control unit 100 processes the engine driving parameter indicative data, i.e. throttle angle position indicative signal $\theta_{th}$, the intake air flow rate indicative signal $S_Q$ which represents an engine load, the engine speed data N, to derive fuel injection amount for each engine cylinder and to produce a fuel injection pulse Si at a controlled timing so that fuel is injected near induction TDC of the corresponding engine cylinder.

In summary, the control unit 100 receives the intake air flow rate indicative signal $S_Q$ as the engine load data Q and the engine speed data N to derive a basic fuel injection amount Tp. The basic fuel injection amount Tp is then corrected on the basis of preselected correction parameters. The control unit 100 sets fuel injection data derived based on the fuel injection amount determined in the process set forth above, is set in the input-/output unit 108. The control unit 100 further monitors the crankshaft angular position based on the crank reference signal $\theta_{ref}$ and the crank position signal $\theta_{pos}$ to determine the fuel injection timing to trigger the fuel injection valve 10 to inject fuel at the controlled timing.

In the preferred embodiment, the control unit 100 detects the engine speed data N indicative of an engine speed higher than a predetermined maximum engine speed to perform fuel cut-off for preventing the engine from running at excessive speed which may damages the engine. In the preferred embodiment, the control unit 100 performs fuel cut-off in intermittent manner. Period to maintain fuel cut-off is determined depending upon the magnitude of the engine speed in excess of an engine speed limit corresponding to the predetermined maximum engine speed. The period to maintain fuel cut-off state will be hereafter referred to as "fuel cut duration".

Figure 3:
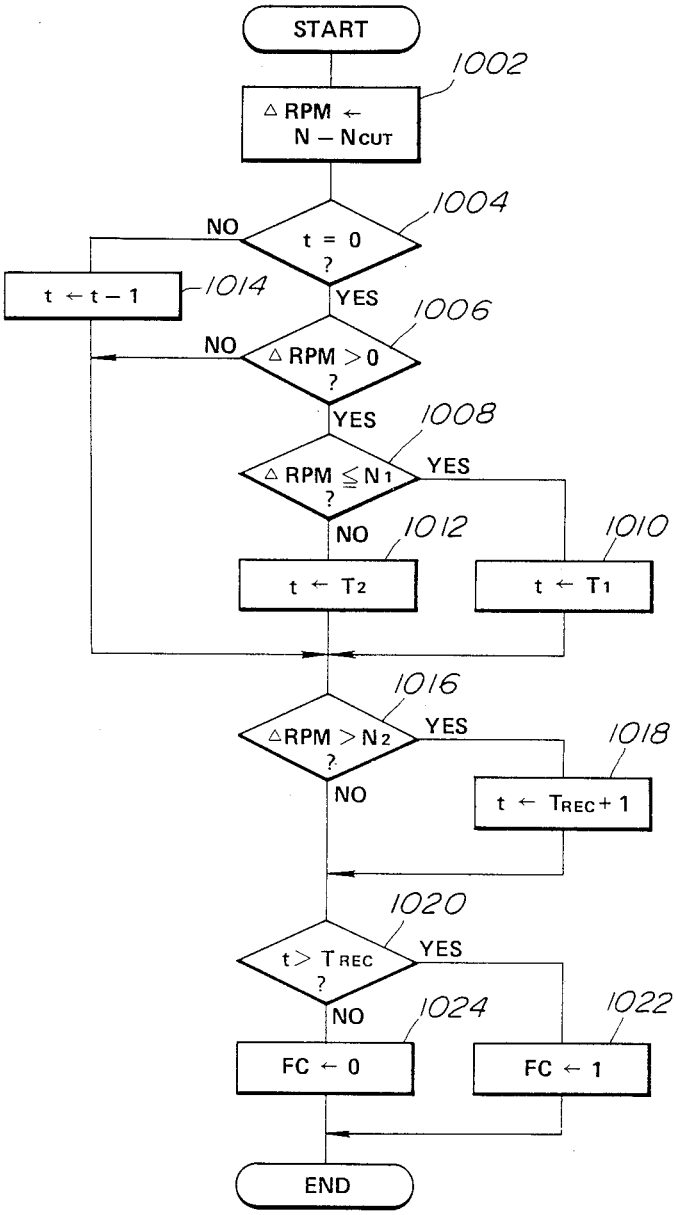
FIG. 3 is a flowchart of a routine for controlling fuel cut-off operation.

Manner of control of fuel cut-off operation to be performed by the control unit 100 will be disclosed herebelow with reference to FIG. 3 which illustrates a routine for controlling fuel cut-off operation. The shown routine is designed to be executed at a predetermined timing in time-synchronous or engine revolution synchronous manner. In the time-synchronous timing, the shown routine is executed at a predetermined constant interval. In the alternative, in engine revolution synchronous timing, the shown routine is executed at every predetermined crankshaft position in engine revolution cycle.

Immediately after starting execution, the engine speed data N is read and compared with a fuel cut threshold $N_{CUT}$ representative of the aforementioned engine speed limit to determined the magnitude of engine speed in excess of the engine speed limit, at a step 1002. The excess magnitude of the engine speed thus derived will be hereafter referred to as "excess speed data ΔRPM". Then, a fuel cut timer value t of a fuel cut timer 114 in the control unit 100, which fuel cut timer 114 is designed to measure elapsed period during fuel cut-off condition is checked whether the timer value is zero (0), at a step 1004. In the practice, the fuel cut timer 114 is set the fuel cut duration $T_1$. The fuel cut timer value is counted down at every execution cycle of the routine of FIG. 3 until the fuel cut timer value becomes zero.

When the fuel cut timer value t as checked at the step 1004 is zero, which means that the instantaneous condition is not fuel cut-off condition, the excess speed data ΔRPM is checked whether it is greater than zero or not, at a step 1006. Namely, at the step 1006, check is performed whether the instantaneous engine speed N is higher than the engine speed limit or not. When the excess speed data ΔRPM is greater than zero, it means that the engine speed N is in excess of the engine speed limit. In this case, the excess speed data ΔRPM is again checked whether it is smaller than or equal to an excess speed reference value $N_1$, at a step 1008. When the excess speed data ΔRPM is smaller than or equal to the excess speed reference value $N_1$, a first fuel cut duration indicative data $T_1$ is set in the fuel cut timer 114, at a step 1010. On the other hand, when the excess speed data ΔRPM is greater than the excess speed reference value $N_1$, a second fuel cut duration indicative data $T_2$ is set in the fuel cut timer 114, at a step 1012.

It should be noted that the second fuel cut duration indicative data $T_2$ has greater value than the first fuel cut duration indicative data $T_1$.

On the other hand, when the fuel cut timer value t is not zero as checked at the step 1004, which means that the instantaneous condition is fuel cut-off condition, process goes to a step 1014 to decrement the fuel cut timer value t by 1 (one).

After one of the steps 1010, 1012 and 1014, the excess speed data ΔRPM is compared with another excess speed reference value $N_2$ which represents substantially excessive engine speed over the engine speed limit, at a step 1016. The excess speed reference value $N_2$ is therefore greater value than excess speed reference value $N_1$ and thus is referred to as "extra high speed indicative reference value". When the excess speed data ΔRPM is greater than the extra high speed indicative reference value $N_2$, process goes to a step 1018 to increment the fuel cut timer value t. Thereafter, the process goes to a step 1020. On the other hand, when the excess speed data ΔRPM is smaller than or equal to the extra high speed indicative reference value $N_2$ as checked at the step 1016, process directly goes to the step 1020 jumping the step 1018. By incrementing the fuel cut timer value t at the step 1018 when the excess speed data ΔRPM is greater than the extra high speed indicative reference value $N_2$, the fuel cut duration is expanded.

At the step 1020, the fuel cut timer value t is compared with a fuel recovery reference value $T_{REC}$. When the fuel cut timer value t is greater than the fuel recovery reference value $T_{REC}$, a fuel cut indicative flag FLCUT is set in a fuel cut flag register 118, in the control unit 100, at a step 1022. On the other hand, when the fuel cut timer value t is smaller than or equal to the fuel recovery reference value $T_{REC}$, the fuel cut indicative flag FLCUT is reset at a step 1024. After setting or resetting the fuel cut indicative flag FLCUT at the step 1022 or 1024, process goes END.

Figure 4:
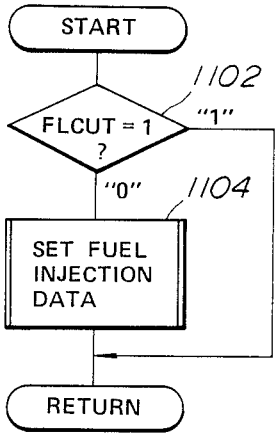
FIG. 4 is a flowchart of a routine for deriving a fuel injection pulse width and outputting the fuel injection pulse.

FIG. 4 shows a fuel injection pulse setting routine for setting fuel injection pulse width. The routine of FIG. 4 is designed to be executed at a given timing in synchronism with engine revolution. Immediately after starting execution, the fuel cut indicative flag FLCUT is checked at a step 1102. When fuel cut indicative flag FLCUT is set as checked at the step 1102, process goes END. On the other hand, when the fuel cut indicative flag FLCUT is reset as checked at the step 1102, fuel injection pulse width data and the fuel injection start timing data are set in the input/output unit 108, at a step 1104.

Figure 5:
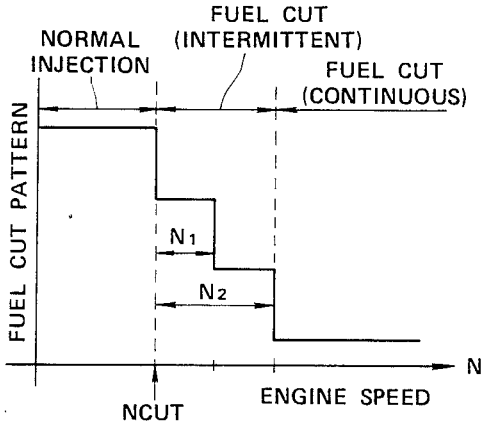
FIG. 5 is a chart showing a pattern of fuel cut-off control to be taken place by the preferred embodiment of the fuel injection control system of FIG. 1.
Figure 6:
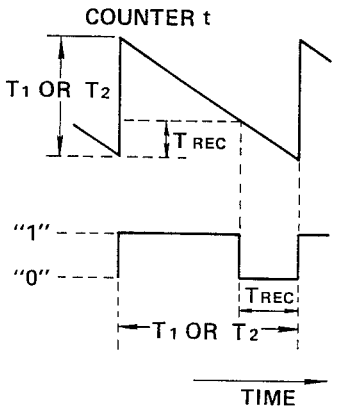
FIG. 6 is a chart showing a relationship between a counter value and fuel cut flag.
Figure 7:
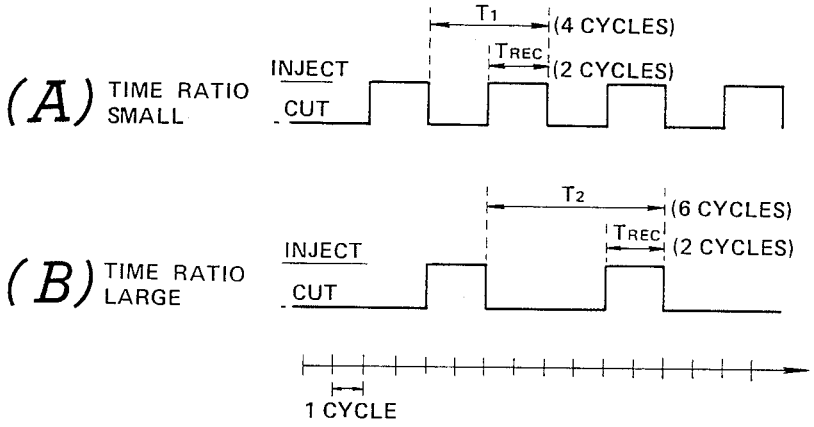
FIGS. 7(A) and 7(B) is a chart showing proportion of fuel injecting period and fuel cut-off period.

In the practical operation, when the engine is accelerated in excess of the engine speed limit, fuel cut-off operation is initiated. As set forth above and as shown in FIG. 5, the fuel cut-off duration is variable between $T_1$ and $T_2$ depending upon the magnitude of the engine speed in excess of the engine speed limits, i.e. $N_1$ and $N_2$. The fuel cut-off duration $T_1$ or $T_2$ derived according to the excess magnitude ΔRPM is set in the fuel cut timer 114 as shown in FIG. 6. The fuel cut timer value t is counted down every cycle of execution of the routine of FIG. 3. As long as the fuel cut timer value t is held greater than the fuel recovery reference value $T_{REC}$, the fuel cut indicative flag FLCUT is held in set position to maintain the fuel injection system at fuel cut-off position, as shown in FIG. 7(A) and 7(B). As will be seen from FIG. 7(A), when the magnitude of the engine speed in excess of the engine speed limit which is represented by the excess speed data ΔRPM is relatively small. i.e. smaller than the excess speed reference value $N_1$, the fuel cut duration is set at shorter period, i.e. $T_1$. In the shown embodiment, the $T_1$ period is set in a length approximately corresponding top four engine revolution cycles. In the shown example of FIG. 7(A), fuel cut-off is in practice performed for first two engine revolution cycles. Fuel resumption is taken place in subsequent two engine revolution cycles. On the other, when the engine speed excess magnitude as represented by the excess speed data ΔRPM is substantial. i.e. greater than or equal to the excess speed reference value $N_1$, the longer fuel cut duration $T_2$ is set. In the practical embodiment, the $T_2$ period to be set corresponds six engine revolution cycles, as shown in FIG. 7(B).

When the fuel cut timer value t is counted down to the fuel recovery reference value $T_{REC}$, the fuel cut indicative flag FLCUT is reset as shown in FIG. 6. Therefore, fuel injection is resumed. Fuel injection is maintained until the fuel cut timer value t reaches to zero.

When the $T_1$ or $T_2$ period expires and the engine speed N is still held higher than the engine speed limit, the fuel cut duration $T_1$ or $T_2$ is again set to the fuel cut timer 114 and thus the fuel cut indicative flag FLCUT is set in the fuel cut flag register 118, as shown in FIGS. 6, 7(A) and 7(B). By repeating this process, fuel cut-off operation is taken place in intermittent manner for smoothly reducing the engine output torque and thus eliminate discomfortable jerking which may caused by engine output fluctuation during transition between fuel cut-off and fuel resumption. Furthermore, since the shown process intermittently resume fuel injection to inject fuel into the intake manifold 12, the inner peripheral of the wall of the intake manifold 12 and the fuel injection valve 10 can be wet enough. Therefore, the amount of fuel injected upon resumption of fuel injection and used for wetting the peripheral wall can be reduced. This allows to control the fuel injection amount upon fuel resumption precisely corresponds to the fuel demand which is determined according to the engine driving condition.

In the shown embodiment, the fuel injection control, especially, fuel cut-off control has been discussed for controlling fuel cut-off operation in time bases. Namely, fuel cut-off duration is set in relation to the engine speed over the engine speed limit for performing fuel cut-off operation over given, variable number of engine revolution cycles. In the shown process, when the fuel injection control is specifically directed for controlling fuel injection for a type of a fuel injection internal combustion engine which performs so-called "sequential injection" to inject a controlled amount of fuel for each engine cylinder at a timing near induction top-dead-center (TDC) of the corresponding cylinder, fuel cut-off will be performed over all of the engine cylinders by maintaining all of the fuel injection valves 10 in deenergized state.

Figure 8:
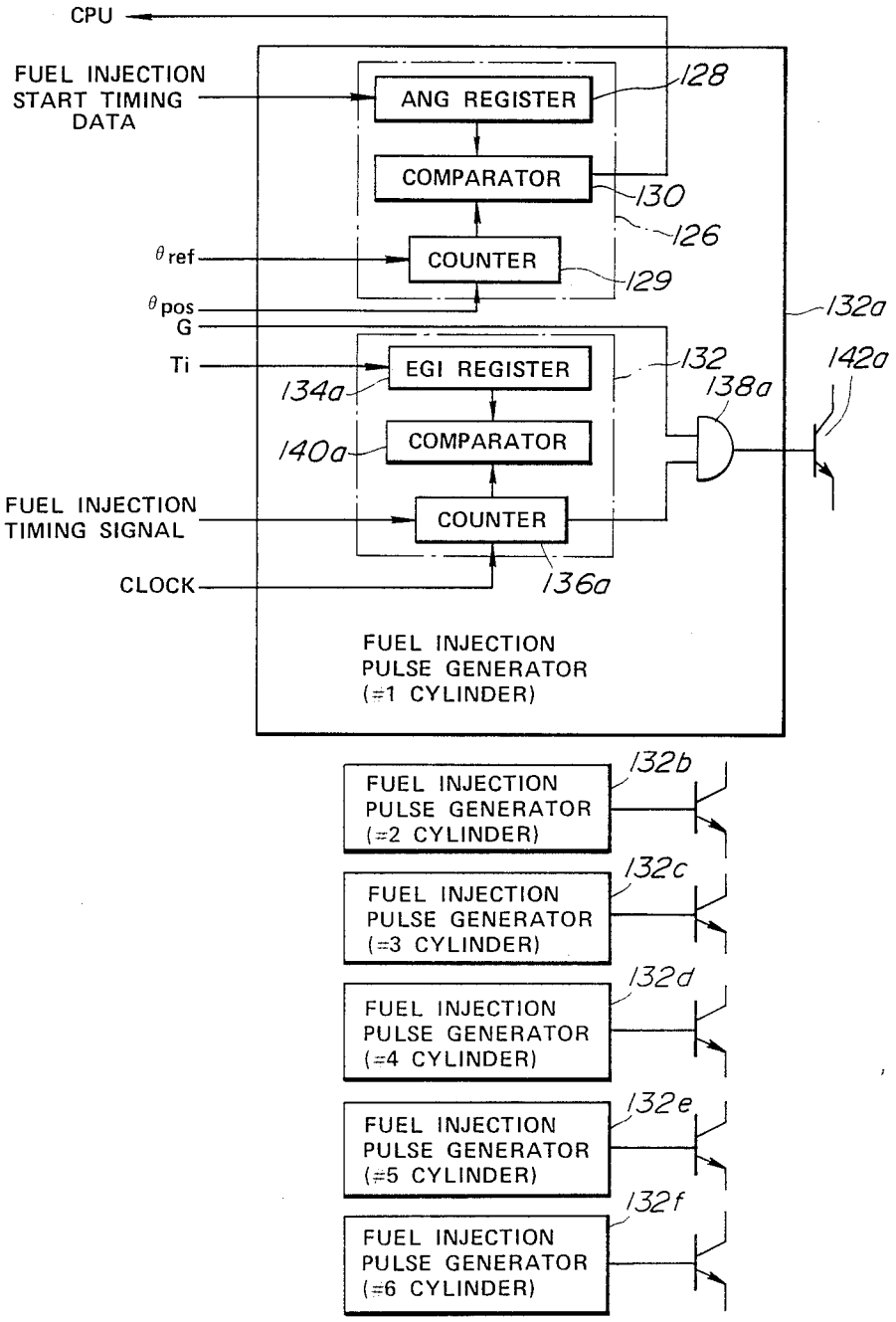
FIG. 8 is a block diagram showing detailed construction of an input/output unit in a control unit of FIG. 2.

FIG. 8 shows detailed construction of the relevant section of the input/output unit 108. The input/output unit 108 has a fuel injection start timing control section 126. The fuel injection start timing control section 126 has an angle (ANG) register 128, to which a fuel injection start timing derived by CPU during process of fuel injection control data, e.g. the air flow rate, throttle angle position, the engine speed and so forth. The fuel injection start timing control section 126 also has a crank position signal counter 129. The crank position signal counter 129 is designed to count up the crank position signals $\theta_{pos}$ and to be reset in response to the crank reference signal $\theta_{ref}$. A comparator 130 is also provided in the fuel injection start timing control section 126. The comparator 130 compares the fuel injection start timing indicative value set in the ANG register 126 and the crank position signal counter value in the counter 129. The comparator 130 outputs HIGH level comparator signal when the crank position signal counter value becomes the same as that of the fuel injection start timing indicative value. The HIGH level comparator signal of the comparator 130 fed to CPU 102 as an interrupt command for triggering fuel injection controlling interrupt routine.

The input/output unit 108 also has a fuel injection pulse output section **132*a* for selectively triggering one of the fuel injection valves 10*a*, 10*b*, 10*c*, 10*d*, 10*e* and 10*f* for performing fuel injection during execution of the aforementioned fuel injection controlling interrupt routine. The fuel injection pulse output section 132 has a plurality of fuel injection pulse generators 132*a*, 132*b*, 132*c*, 132*d*, 132*e* and 132*f*, each of which corresponds one of fuel injection valves 10*a*, 10*b*, 10*c*, 10*d*, 10*e* and 10*f***.

Each fuel injection pulse generator **132*a*, 132*b*, 132*c*, 132*d*, 132*e* and 132*f* has identical circuit construction to each other. Therefore, the following discussion will be concentrated for the fuel injection pulse generator 132*a*. The circuit constructions and operations thereof of the fuel injection pulse generators 132*b*, 132*c*, 132*d*, 132*e* and 132*f* will not be discussed in detail and simply identify the corresponding components with the reference numerals common to that of the fuel injection pulse generator 132*a***, with subscripts same as that identifying the fuel injection pulse generators.

The fuel injection pulse generator **132*a* comprises a fuel injection (EGI) register 134*a*, a clock counter 136*a*, an AND gate 138*a*, a comparator 140*a* and a power transistor 142*a*. A fuel injection pulse width data which is determined through data processing during execution of fuel injection control routine to be discussed later, is set in the EGI register 134*a*. One input of the AND gate 138*a* is connected to the output of the comparator 140*a* to receive the comparator signal. To the other input of the AND gate 138*a*, a gate signal G which identifies the fuel injection valve 10*a*, 10*b*, 10*c*, 1O*d*, 1O*e* and 1O*f*** to perform fuel injection, is input. Namely, the gate signal G is produced in synchronism with the engine revolution cycle. Therefore, only one of the AND gates is responsive to the HIGH level comparator signal to generate HIGH level gate signal.

The output of the AND gate 138a is the power transistor 142a for triggering one the fuel injection valve 10a, 10b, 10c, 10d, 10e and 10f selected by the gate signal G for performing fuel injection for the engine cylinder approaching the induction TDC. The clock counter 136a also receives a fuel injection timing signal to reset the counter value thereof. The fuel injection timing signal is to be generated every given timing, every 720° of engine revolution. Therefore, in the shown embodiment, the fuel injection timing signal is produced in response to the crank reference signal $\theta_{ref}$ generated at 70° BTDC of the specific engine cylinder.

The clock counter 136a is connected to a clock generator in the control unit 100 to receive therefrom a clock pulse. The clock counter 136a counts up the clock pulse. At the same time, the comparator 140a is triggered in response to resetting of the clock counter 136a to output HIGH level comparator signal to the base electrode of the power transistor 142a. The power transistor 142a is thus turned ON to open the fuel injection valve 10a to perform furl injection for No. 1 engine cylinder.

When the counter value of the clock counter 136a reaches the fuel injection pulse width value set in the EGI register 134a, the comparator signal of the comparator 140a turns into LOW level to turn OFF the power transistor 142a. By turning OFF of the power transistor 142a, the fuel injection valve 10a closes to terminate fuel injection.

The ANG register 128 in the fuel injection start timing control section 126 updates the set fuel injection start timing data at every occurrence of the crank reference signal $\theta_{ref}$.

With this arrangement, fuel injection starts at the timing set in the ANG register 128 and is maintained for a period as set in the EGI register 134a. By this, the fuel injection amount can be controlled by adjusting the fuel injection pulse width.

Figure 9:
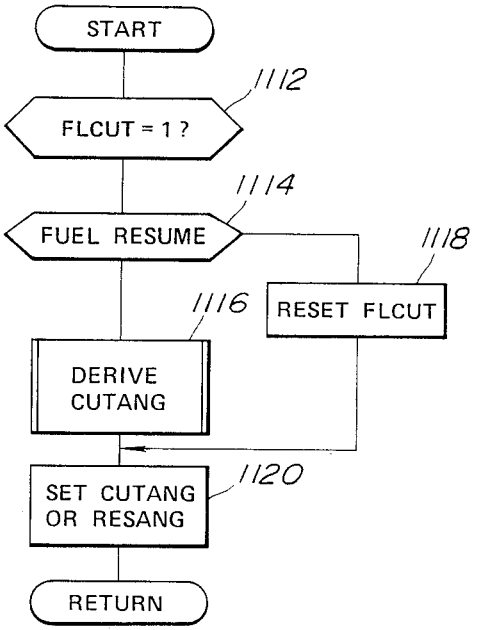
FIG. 9 is a flowchart of a routine for setting a fuel cut-off timing in the input/output unit of FIG. 8.

FIG. 9 shows a flowchart for setting fuel cut-off and fuel resume timing in the input/output unit 108. It should be noted that the fuel cut-off and resume timing is to be set so that fuel cut-off timing and resume timing is set to initiate fuel cut off and fuel resumption at the timing substantially corresponding to intake valve close timing. A period for delivering the fuel into the engine cylinder via the intake valve from injection through the fuel injection valve is substantially constant irrespective of the engine speed and the intake vacuum. Therefore, an advance angle $\theta_T$ for initiate fuel cut-off or perform fuel resumption relative to the intake valve close timing can be calculated by:

$$\theta_T N \times 1/60 \times 360° \times T_t/1000$$

where $T_t$ is period required for delivery of fuel from injection at the fuel injection valve.

Based on the advance angle $\theta_T$, the fuel cut-off or resume timing data is derived. In the preferred embodiment, the fuel cut-off or resume timing data is constituted by two bit data. Upper, first bit representative of the cylinder number data to initiate fuel cut-off or to resume fuel injection and lower, second bit represents angle from the timing of occurrence of the crank reference signal $\theta_{ref}$. The fuel cut-off or resume timing data is set in the ANG register 128 of the input/output unit 108.

The fuel cut-off or resume timing can be arithmetically derived in real-time calculation. On the other hand, the fuel cut-off timing and fuel resume timing can be derived by table look-up utilizing a table map set in terms of engine speed N. Furthermore, it may be possible to use a fixed angle in case the engine speed to perform fuel cut-off and to resume fuel injection is known.

The routine of FIG. 9 is executed every predetermined timing. Immediately after starting execution, the fuel cut indicative flag FLCUT is checked at a step 1112. If the fuel cut indicative flag FLCUT is not set, the process goes END to allow setting of normal fuel injection data. One of the advanced example of the process in the setting of the fuel injection data has been disclosed in the co-pending U.S. patent application Ser. No. 143,087, filed on Jan. 12, 1988.

On the other hand, when the fuel cut indicative flag FLCUT is set as checked at the step 1112, check is performed whether a given fuel resuming condition, such as fuel cut period expires, engine speed drops below a given fuel recovery speed, at a step 1114. If the fuel resuming condition is not satisfied as checked at the step 1114, process goes to a step 1116 to fuel cut-off timing data CUTANG. On the other hand, when the fuel resuming condition is satisfied as checked at the step 1114, the fuel cut indicative flag FLCUT is reset at a step 1118 and thereafter the fuel resume timing data RESANG is derived at a step 1120.

The fuel cut-off timing data CUTANG derived at the step 1116 or the fuel resume timing data RESANG derived at the step 1120 is set in the ANG register 128 of the input/output unit 108, at a step 1122.

Figure 10:
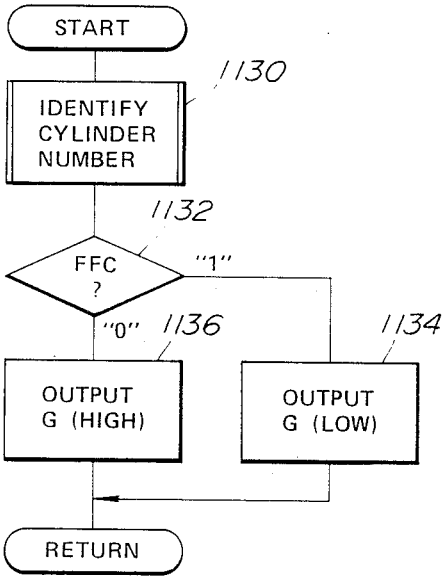
FIG. 10 is a flowchart of a routine for controlling fuel cut-off operation.

FIG. 10 shows a routine governing fuel cut-off operation. This routine is triggered at the timing when the counter value of the crank position signal counter 129 reaches the set timing data, i.e. CUTANG or RESANG.

At a step 1130, the engine cylinder number to perform fuel cut-off or to resume fuel injection is discriminated on the basis of the first bit data of the CUTANG or RESANG data. Then, the fuel cut indicative flag FLCUT is checked at a step 1132. When the fuel cut indicative flag FLCUT is set, the gate signal G to be input to the AND gate 138a of the engine cylinder identified at the step 1130 is set to zero, at a step 1134. On the other hand, when the fuel cut indicative flag FLCUT is reset, the gate signal G to be input to the AND gate 138a of the engine cylinder identified at the step 1130 is set to one, at a step 1136.

Figure 11:
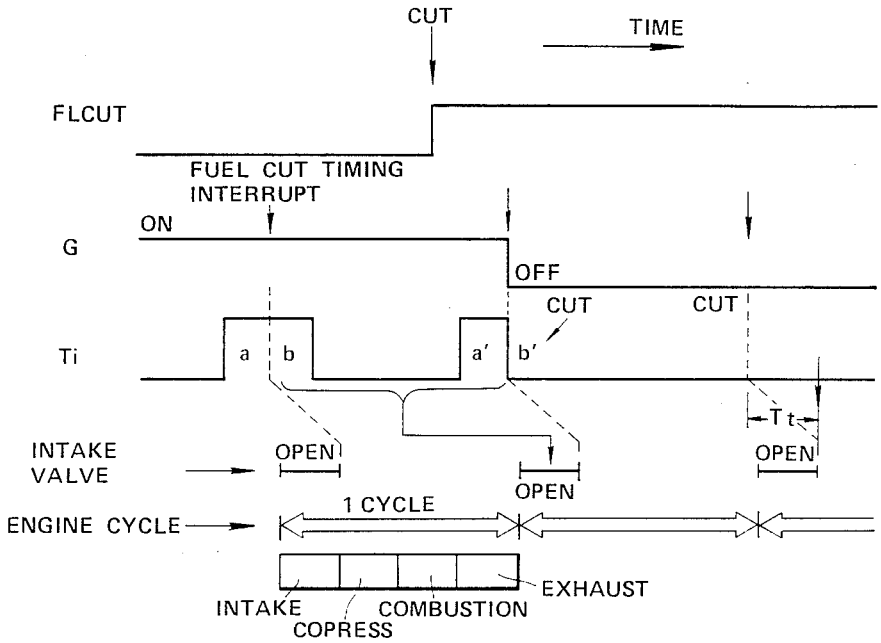
FIG. 11 is a chart showing fuel injection pulse upon starting of fuel cut-off.
Figure 12:
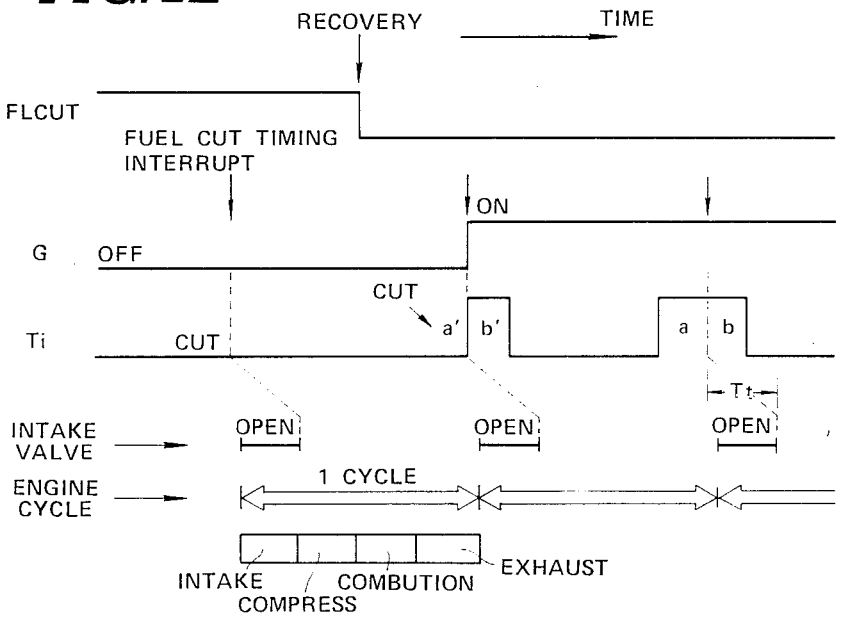
FIG. 12 is a chart showing fuel injection pulse upon fuel recovery

By the process set forth above, fuel cut-off timing is performed at the end of the intake valve open period of the engine cylinder about which fuel cut-off condition is satisfied, as shown in FIG. 11. On the other hand, when the fuel resuming condition is satisfied, fuel resumption is triggered at the timing corresponding to the end of the intake valve open period of one of the engine cylinder about which fuel resuming condition is detected, as shown in FIG. 12.

While the foregoing embodiment performs fuel cut-off operation for a predetermined period which is synchronous to engine revolution cycle and depends upon the excess magnitude of engine speed over the engine speed limit, it may be possible to perform fuel cut-off operation with improved output torque transition between fuel cut-off state and fuel resume state. For example, such fuel cut-off operation can be performed by limiting number of engine cylinder to perform fuel cut-off operation. This will be hereafter referred as "partial fuel cut-off" throughout the disclosure. The partial fuel cut-off is possible for so-called "sequential injection"

type fuel injection system in which fuel injection for each engine cylinder is performed independently of that for other cylinders, at a controlled timing in synchronism with engine revolution cycle. In case of partial fuel cut-off, number of the engine cylinder to perform fuel cut-off may be variable depending upon the excess magnitude of engine speed over the engine speed limit. The followings are discussion for another embodiment of the fuel injection control system with fuel cut-off control, according to the invention, which is directed to perform variable cylinder number partial fuel cut-off.

Figure 13:
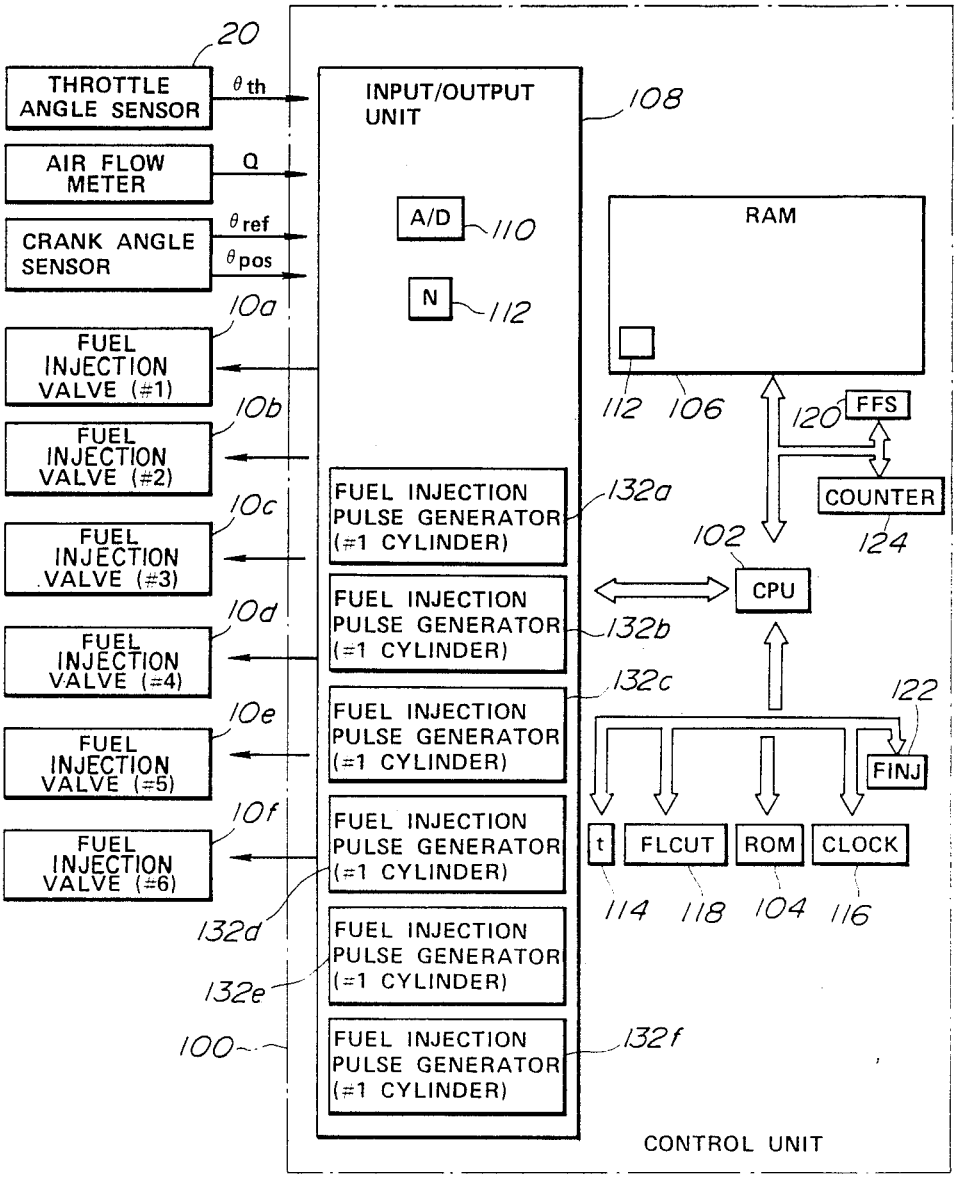
FIG. 13 is a block diagram showing detailed construction of another embodiment of the input/output unit in a control unit of FIG. 2.

It will be appreciated that the hardware construction of the fuel injection system to perform variable cylinder number partial fuel cut-off is substantially the same as that illustrated in FIG. 1. Therefore, the detailed discussion about the hardware construction will be neglected. Circuit construction of the control unit employed for this embodiment of the fuel injection control system is shown in FIG. 13. In the circuit elements in FIG. 13 common to the former embodiment will be represented by the same reference numerals and are neglected detailed discussion. The circuit elements not in common to the former embodiment will be discussed in the discussion of the preferred process in control of the partial fuel cut-off operation with reference to the subsequent drawings.

Figure 14:
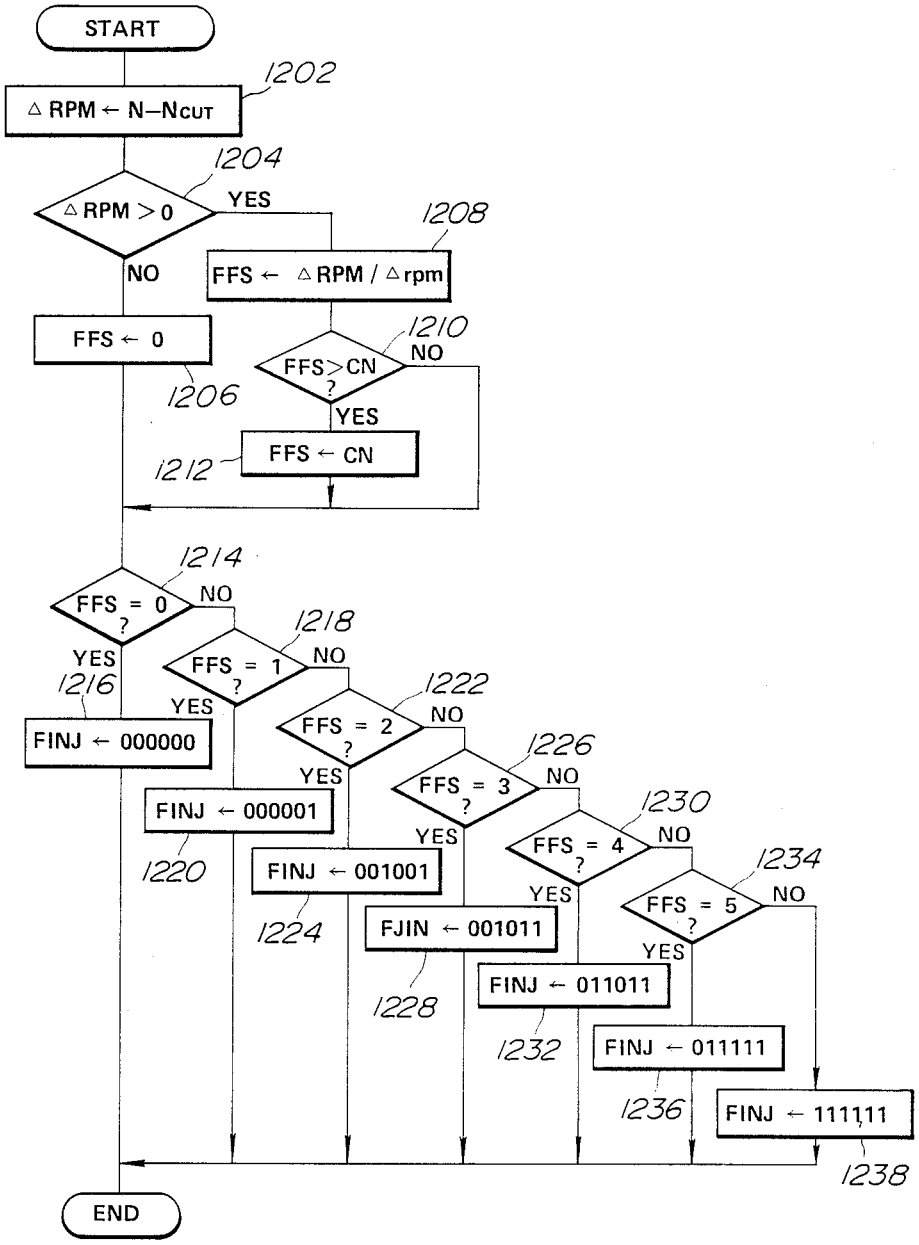
FIG. 14 is a flowchart of a routine for identifying engine cylinders to perform fuel cut-off operation.

FIG. 14 shows a flowchart of a routine for identifying engine cylinder or cylinders to perform fuel cut-off operation. The shown routine is designed to be executed at every given timing determined based on time or in synchronism with the engine revolution cycle.

Immediately after starting execution, the excess speed data ΔRPM which is difference between the actual engine speed N and the fuel cut threshold $N_{CUT}$, is derived at a step 1202. The excess speed data ΔRPM derived at the step is checked whether it is greater than zero in order to check whether engine speed N is higher than the engine speed limit, at a step 1204. When the excess speed data ΔRPM is smaller than or equal to zero, which means that the engine speed is lower than the engine speed limit, the process goes to a step 1206 to set a cylinder number indicative data FFS which represents number of engine cylinder to perform fuel cut-off in partial fuel cut-off and is stored in a register 120 in the control unit of FIG. 13. The register 120 will be hereafter referred to as "FFS register" throughout the following disclosure.

Figures 15, 16:
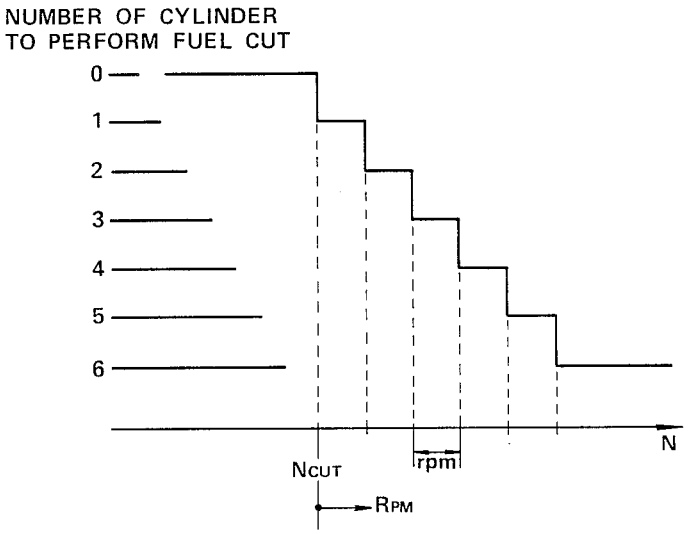
FIG. 15 is a chart showing relationship between number of engine cylinder for which fuel cut-off operation is taken place, and an engine speed.
FIG. 16 is an explanatory table showing schedule of engine cylinders to perform fuel cut-off.

On the other hand, when the excess speed data ΔRPM is greater than zero as checked at the step 1204, process goes to a step 1208 to determine number of engine cylinders to perform fuel cut-off. As shown in FIG. 15, number of engine cylinders to perform fuel cut-off is variable depending upon the excess speed data ΔRPM. For instance, when the excess magnitude of the engine speed over the speed limit is small, fuel cut-off may be performed at single engine cylinder. On the other hand, when the excess magnitude of the engine speed over the engine speed limit is substantial, fuel cut-off may be performed for all of the engine cylinders, at all six cylinders in case of 6-cylinder engine. The number of engine cylinder to perform fuel cut-off may be stepwise increased as increasing the excess magnitude of the engine speed over the engine speed limit. Therefore, as shown in FIG. 15, in the shown embodiment, number of engine cylinder to perform fuel cut-off is determined by dividing the excess speed data ΔRPM with cylinder number derivation reference value Δrpm. Based on the result, the number of cylinders to perform fuel cut-off is determined in a manner illustrated in FIG. 15. The cylinder number indicative data FFS having a value indicative of the determined number of the engine cylinders to perform fuel cut-off, is then set to the fuel cut flag register 118, at a step 1208. Then, the cylinder number indicative data FFS is compared with a value CN, e.g. "6", indicative of the total cylinder number of the engine at a step 1210. When the cylinder number indicative value FFS is greater than the total cylinder number CN. the cylinder number indicative value FFS is set at the total cylinder number CN at a step 1212.

After the step of 1204 or 1212, process goes to a step 1214. At the step 1214, the cylinder number indicative value FFS is compared with zero (0). If so, a fuel injection control flag FINJ to be set in a fuel injection control flag register 122 in the control unit 100, is set in a value "000000", at a step 1206. When the cylinder number indicative value FFS is not zero (0) as checked at the step 1214, the cylinder number indicative value FFS is compared with one (1). at a step 1218. If the cylinder number indicative value is equal one, the fuel injection control flag FINJ is set in "000001", at a step 1220. When the cylinder number indicative value FFS is not one (1) as checked at the step 1218, the cylinder number indicative value FFS is compared with two (2), at a step 1222. If the cylinder number indicative value is equal two, the fuel injection control flag FINJ is set in "001001", at a step 1224. When the cylinder number indicative value FFS is not two (2) as checked at the step 1222, the cylinder number indicative value FFS is compared with three (3), at a step 1226. If the cylinder number indicative value is equal three, the fuel injection control flag FINJ is set in "001011", at a step 1228. When the cylinder number indicative value FFS is not three (3) as checked at the step 1226, the cylinder number indicative value FFS is compared with four (4), at a step 1230. If the cylinder number indicative value is equal four, the fuel injection control flag FINJ is set in "011011", at a step 1232. When the cylinder number indicative value FFS is not four (4) as checked at the step 1230, the cylinder number indicative value FFS is compared with five (5), at a step 1234. If the cylinder number indicative value is equal five, the fuel injection control flag FINJ is set in "011111", at a step 1236. When the cylinder number indicative value FFS is not five (5) as checked at the step 1230, the fuel injection control flag FINJ is set in "111111", at a step 1238.

In the shown process, each bit in the fuel injection control flag FINJ represents fuel injecting condition and fuel cut-off condition of the corresponding engine cylinder. Namely, when the one bit is set at "1", the corresponding engine cylinder is to be performed fuel cut-off. Priority to perform fuel cut-off may be determined in various ways. Assuming the spark ignition for the engine cylinders is taken place in order of No. 1 cylinder, No. 2 cylinder, No. 3 cylinder, No. 4 cylinder, No. 5 cylinder and No. 6 cylinder, such as in case of V-type 6 cylinder engine, the engine cylinders to respectively correspond to each bit of the fuel injection control flag FINJ are as shown in FIG. 16. In FIG. 16, the figures respectively represents the engine cylinder number and the figures encircled represent engine cylinders for which fuel cut-off operation is to be performed.

Figures 17, 18:
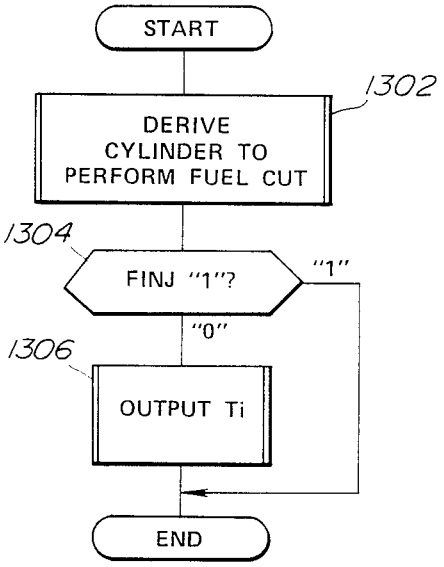
FIG. 17 is an explanatory table showing another schedule of engine cylinders to perform fuel; cut-off.
FIG. 18 is a flowchart showing a modified routine for identifying engine cylinders to perform fuel cut-off operation.

FIG. 17 shows variation of the pattern to determine the engine cylinders to perform fuel cut-off operation. In this case, the engine cylinder to perform fuel cut-off is determined irrespective of the engine revolution cycles and order to perform spark ignition.

It would be advisable that when the fuel injection system of the specific cylinder has a tendency to supply richer mixture for one engine cylinder and leaner mixture for another engine cylinder, the engine cylinder tends to be supplied the richer mixture may be given higher priority in determination of the engine cylinder to perform fuel cut-off operation. FIG. 18 shows a flowchart of fuel injection pulse setting routine for setting fuel injection data for the input/output unit 108 of the control unit 100.

Immediately after starting execution, discrimination is made in connection with the crank angle sensor signals. i.e. crank reference signal $\theta_{ref}$ and or crank position signal $\theta_{pos}$, at a step 1302. In practice, 70° BTDC position of the reference engine cylinder, such as No. 1 cylinder, can be detected by detecting the unique pulse width of the crank reference signal $\theta_{ref}$ which is different from that of others. In order to discriminate the engine cylinder number which approach the induction TDC, an engine cylinder number counter 124 may be provided in the control unit 100. The engine cylinder number counter 124 is designed to be reset in response to the crank reference signal $\theta_{ref}$ representative of 70° BTDC of the reference engine cylinder and counts up the crank reference signal $\theta_{ref}$.

Therefore, by checking the value in the engine cylinder number counter 124, discrimination of the engine cylinder approaching the induction TDC is made. At a step 1304, bit data of the fuel injection control flag FINJ corresponding to the discriminated engine cylinder, is checked. When the bit data as checked at the step 1304 is "1" which indicates that the fuel cut-off is to be performed, process goes END. On the other hand, the fuel injection data derived on the fuel injection control parameters is set in the input/output unit 108 of the control unit 100, at a step 1306.

By the process set forth above, partial fuel cut-off operation can be performed with adjustment of the engine cylinder number to perform fuel cut-off depending upon the excess magnitude of the engine speed over the engine speed limit. This successfully reduces engine output torque fluctuation in transition between fuel cut-off and fuel resumption.

Figure 19:
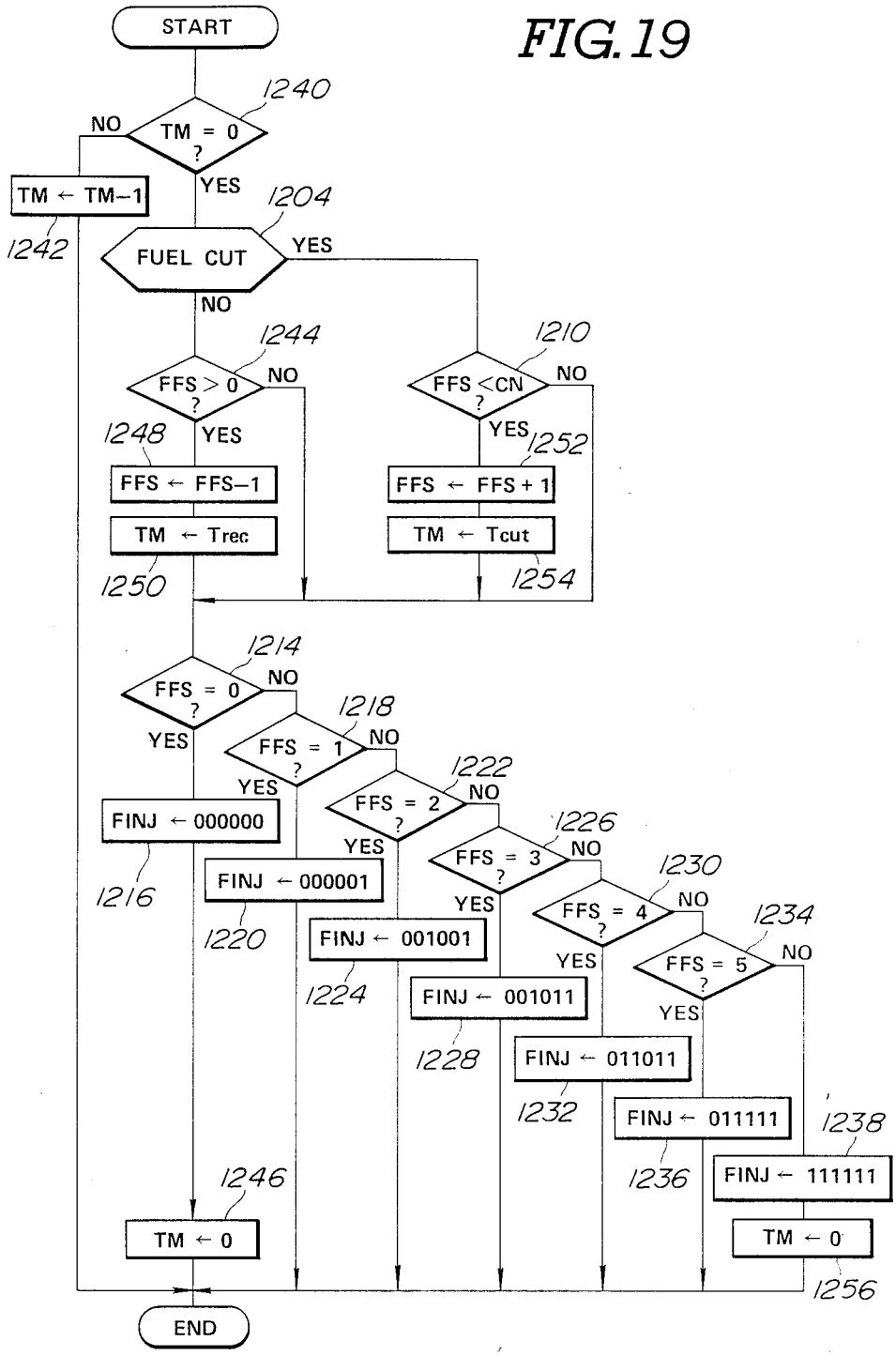
FIG. 19 is a flowchart of a modified routine for identifying engine cylinders to perform fuel cut-off operation.

FIG. 19 shows a modified process of the routine of FIG. 14. In the following discussion, the process steps performing the identical function as that performed in the routine of FIG. 14 will be represented by the same step numbers as that used in FIG. 14.

Immediately after starting execution, fuel cut-off timer value TM is checked at a step 1240. If the fuel cut-off timer value TM is not zero, process goes to a step 1242 to decrement the timer value TM by 1. After decrementing the timer value TM by 1, process goes END.

On the other hand, when the fuel cut-off timer value TM is zero as checked at the step 1240, process goes to the step 1202 to derive the excess speed data ΔRPM. Then, at a step 1204, the excess speed data ΔRPM is checked whether it is greater than zero so as to detect engine fuel cut-off condition or not. When the excess speed data ΔRPM is smaller than or equal to zero, process goes to the step 1244, the cylinder number indicative data FFS is checked. When the cylinder number indicative data FFS is zero, then process directly goes to the step 1214.

In the shown modification, additional step 1246 after the step 1216 is provided to set the fuel cut timer value to zero.

On the other hand, when the cylinder number indicative data FFS is greater than zero as cheCked at the step 1244, process goes to a step 1248 to decrement the cylinder number indicative data FFS by 1. After decrementing the cylinder number indicative data FFS, a predetermined recovery delay time value $T_{rec}$ is set as the fuel cut-off timer value TM at a step 1250.

When the excess speed data ΔRPM as checked at the step 1204 is greater than zero, process goes to the step 1208 to to determine number of engine cylinders to perform fuel cut-off. Then, the cylinder number indicative data FFS is compared with a value CN, e.g. "6", indicative of the total cylinder number, at a step 1210. When the cylinder number FFS is greater than the total cylinder number, the FFS value is set to the value corresponding to the total cylinder number at a step 1212.

On the other hand, cylinder number indicative data FFS is smaller than the total cylinder number, process goes to a step 1252 to increment the cylinder number indicative data FFS by 1. Then, the fuel cut-off delay timer value $T_{cut}$ is set as the fuel cut-off timer value TM, at a step 1254. After the step 1212 or 1254, process goes to the step 1214.

Additional step 1256 is provided after the step 1216 is provided to set the fuel cut timer value to zero.

As discussed above, the fuel injection control system according to the present invention successfully suppress engine output torque fluctuation and whereby reduces jerking during transition at initiation of fuel cut-off state and upon resumption of fuel injection. Therefore, the present invention fulfills all of the objects and advantages sought therefor.

What is claimed is:

1. A fuel injection control system for an internal combustion engine, for performing fuel cut-off operation for blocking fuel delivery in response to an excessively high engine speed over a predetermined high engine speed criterion for protecting the engine, comprising:

a fuel injection system including a fuel injection valve for delivering a controlled amount of fuel at a controlled timing;

a sensor means for monitoring engine driving condition parameters including an engine revolution speed; and a controller, associated with said fuel injection system for controlling fuel delivery amount and fuel injection timing based on the engine driving parameters monitored by said sensor means, said controller being responsive to the engine revolution speed higher than a predetermined fuel cut speed which is set in the vicinity of said predetermined high engine speed criterion, to initiate fuel cut-off operation to intermittently block fuel delivery through said fuel injection valve.

2. A fuel injection control system as set forth in claim 1, wherein said controller derives ratio of fuel delivery blocking period and fuel delivery permitting period on the basis of magnitude of engine speed in excess of said predetermined fuel cut speed.

3. A fuel injection control system as set forth in claim 2, wherein said controller derives a period of a fuel cut cycle, which fuel cut cycle period being variable depending upon the excess magnitude of the engine speed over said predetermined fuel cut speed, said fuel cut cycle including a fuel cut-off period and fuel resuming period, and said controller repeats fuel cut cycles until engine speed is decelerated below a predetermined fuel resuming speed.

4. A fuel injection control system as set forth in claim 3, wherein said controller orders fuel cut-off for said fuel cut-off period and subsequently orders fuel resumption for said fuel resuming period after said fuel cut period expires.

5. A fuel injection control system as set forth in claim 4. wherein said controller orders fuel cut-off at a timing corresponding to at the end of an intake valve open period after fuel cut-off condition is satisfied and orders fuel resumption at a timing corresponding to at the end of an intake valve open period after fuel resume condition is satisfied.

6. A fuel injection control system as set forth in claim 2, wherein said controller derives number of engine cylinders to block fuel delivery based on the excess magnitude of engine speed over said predetermined fuel cut speed for performing fuel cut-off operation for the determined number of engine cylinders and for maintaining fuel injection for remaining cylinders.

7. A fuel injection control system as set forth in claim 6, wherein said controller identifies engine cylinders to perform fuel cut-off based on the number of engine cylinders to perform fuel cut-off.

8. A fuel injection control system for an internal combustion engine, for performing fuel cut-off operation for blocking fuel delivery in response to an excessively high engine speed over a predetermined high engine speed criterion for protecting the engine, comprising:

a fuel injection system including a fuel injection valve for delivering a controlled amount of fuel at a controlled timing;

a sensor means for monitoring engine driving condition parameters including an engine revolution speed; and a controller, associated with said fuel injection system for controlling fuel delivery amount and fuel injection timing based on the engine driving parameters monitored by said sensor means, said controller being responsive to the engine revolution speed higher than a predetermined fuel cut speed which is set in the vicinity of said predetermined high engine speed criterion, to initiate fuel cut-off operation, said controller driving a period of a fuel cut cycle, which fuel cut cycle period being variable depending upon magnitude of the engine speed over said predetermined fuel cut speed, said fuel cut cycle including a fuel cut-off period and fuel resuming period, and said controller repeats fuel cut cycle until engine is decelerated below a predetermined fuel resuming speed which is set in the vicinity of said predetermined high engine speed criterion and at a speed lower than said fuel cut-off speed.

9. A fuel injection control system as set forth in claim 8, wherein said controller orders fuel cut-off for said fuel cut-off period and subsequently orders fuel resumption for said fuel resuming period after said fuel cut period expires.

10. A fuel injection control system as set forth in claim 9, wherein said controller orders fuel cut-off at a timing corresponding to at the end of an intake valve open period after fuel cut-off condition is satisfied and orders fuel resumption at a timing corresponding to at the end of an intake valve open period after fuel resume condition is satisfied.

11. A fuel injection control system for an internal combustion engine, for performing fuel cut-off operation for blocking fuel delivery in response to an excessively high engine speed over a predetermined high engine speed criterion for protecting the engine, comprising:

a fuel injection system including a fuel injection valve for delivering a controlled amount of fuel at a controlled timing;

a sensor means for monitoring engine driving condition parameters including an engine revolution speed; and a controller, associated with said fuel injection system for controlling fuel delivery amount and fuel injection timing based on the engine driving parameters monitored by said sensor means, said controller being responsive to the engine revolution speed higher than a predetermined fuel cut speed which is set in the vicinity of said predetermined high engine speed criterion, to initiate fuel cut-off operation, said controller deriving number of engine cylinders to block fuel delivery based on the excess magnitude of engine speed over said predetermined fuel cut speed for performing fuel cut-off operation for the determined number of engine cylinders and for maintaining fuel injection for remaining cylinders.

12. A fuel injection control system as set forth in claim 11, wherein said controller orders fuel cut-off at a timing corresponding to at the end of an intake valve open period after fuel cut-off condition is satisfied and orders fuel resumption at a timing corresponding to at the end of an intake valve open period after fuel resume condition is satisfied.

13. A fuel injection control system as set forth in claim 11, wherein said controller identifies engine cylinders to perform fuel cut-off based on the number of engine cylinders to perform fuel cut-off.

14. A fuel delivery control system for an internal combustion engine, for performing fuel cut-off operation for blocking fuel delivery in response to an excessively high engine speed over a predetermined high engine speed criterion for protecting the engine, comprising:

a fuel delivery system including a fuel delivery means for delivering a controlled amount of fuel at a controlled timing;

a sensor means for monitoring engine driving condition parameters including an engine revolution speed; and a controller, associated with said fuel delivery system for controlling fuel delivery amount and fuel delivery timing based on the engine driving parameters monitored by said sensor means, said controller being responsive to the engine revolution speed higher than a predetermined fuel cut speed which is set in the vicinity of said predetermined high engine speed criterion, to initiate fuel cut-off operation to intermittently block fuel delivery through said fuel delivery means.

15. A fuel delivery control system for an internal combustion engine, for performing fuel cut-off operation for blocking fuel delivery in response to an excessively high engine speed over a predetermined high engine speed criterion for protecting the engine, comprising:

a fuel delivery system including a fuel delivery means for delivering a controlled amount of fuel at a controlled timing;

a sensor means for monitoring engine driving condition parameters including an engine revolution speed; and a controller, associated with said fuel delivery system for controlling fuel delivery amount and fuel delivery timing based on the engine driving parameters monitored by said sensor means, said controller being responsive to the engine revolution speed higher than a predetermined fuel cut speed which is set in the vicinity of said predetermined high engine speed criterion, to initiate fuel cut-off operation, said controller driving a period of a fuel cut cycle, which fuel cut cycle period being variable depending upon magnitude of the engine speed over said predetermined fuel cut speed, said fuel cut cycle including a fuel cut-off period and fuel resuming period, and said controller repeats fuel cut cycle until engine is decelerated below a predetermined fuel resuming sped which is set in the vicinity of said predetermined high engine speed criterion and at a speed lower than said fuel cut-off speed.

16. A fuel delivery control system for an internal combustion engine, for performing fuel cut-off operation for blocking fuel delivery in response to an excessively high engine speed over a predetermined high engine speed criterion for protecting the engine, comprising:

a fuel delivery system including a fuel delivery means for delivering a controlled amount of fuel at a controlled timing:

a sensor means for monitoring engine driving condition parameters including an engine revolution speed; and a controller, associated with said fuel delivery system for controlling fuel delivery amount and fuel delivery timing based on the engine driving parameters monitored by said sensor means, said controller being responsive to the engine revolution speed higher than a predetermined fuel cut speed which is set in the vicinity of said predetermined high engine speed criterion, to initiate fuel cut-off operation, said controller driving number of engine cylinders to block fuel delivery based on the excess magnitude of engine speed over said predetermined fuel cut speed for performing fuel cut-off operation for the determined number of engine cylinders and for maintaining fuel delivery for remaining cylinders.

17. A fuel injection control system for an internal combustion engine, for performing fuel cut-off operation for blocking fuel delivery in response to an excessively high engine speed over a predetermined high engine speed criterion for protecting the engine, comprising:

a fuel injection system including a fuel injection valve for delivering a controlled amount of fuel at a controlled timing;

a sensor means for monitoring engine driving condition parameters including an engine revolution speed and a crankshaft angular position; and a controller, associated with said fuel injection system for controlling fuel delivery amount and fuel injection timing based on the engine driving parameters monitored by said sensor means, said controller being responsive to the engine revolution speed higher than a predetermined fuel cut speed which is set in the vicinity of said predetermined high engine speed criterion, to initiate fuel cut-off operation to intermittently block fuel delivery through said fuel injection valve, said controller deriving initiation timing on the basis of said crankshaft angular position and known valve timing of an intake valve for performing said fuel cut-off operation so that fuel cut-off is initiated at a close timing of an intake valve.

18. A fuel injection control system for an internal combustion engine, for performing fuel cut-off operation for blocking fuel delivery in response to an excessively high engine speed over a predetermined high engine speed criterion for protecting the engine, comprising:

a fuel injection system including a fuel injection valve for delivering a controlled amount of fuel at a controlled timing;

a sensor means for monitoring engine driving condition parameters including an engine revolution speed and a crankshaft angular position; and a controller, associated with said fuel injection system for controlling fuel delivery amount and fuel injection timing based on the engine driving parameters monitored by said sensor means, said controller being responsive to the engine revolution speed higher than a predetermined fuel cut speed which is set in the vicinity of said predetermined high engine speed criterion, to initiate fuel cut-off operation, said controller deriving a period of a fuel cut cycle, which fuel cut cycle period being variable depending upon magnitude of the engine speed over said predetermined fuel cut speed, said fuel cut cycle including a fuel cut-off period and fuel resuming period, and said controller repeats fuel cut cycle until engine is decelerated below a predetermined fuel resuming speed which is set in the vicinity of said predetermined high engine speed criterion and at a speed lower than said fuel cut-off speed, said controller driving initiation timing on the basis of said crankshaft angular position and known valve timing of an intake valve for performing said fuel cut-off and fuel resuming operation so that fuel cut-off and fuel resumption is initiated at a close timing of said intake valve.

19. A fuel injection control system for an internal combustion engine, for performing fuel cut-off operation for blocking fuel delivery in response to an excessively high engine speed over a predetermined high engine speed criterion for protecting the engine, comprising:

a fuel injection system including a fuel injection valve for delivering a controlled amount of fuel at a controlled timing;

a sensor means for monitoring engine driving condition parameters including an engine revolution speed and a crankshaft angular position; and a controller, associated with said fuel injection system for controlling fuel delivery amount and fuel injection timing based on the engine driving parameters monitored by said sensor means, said controller being responsive to the engine revolution speed higher than a predetermined fuel cut speed which is set in the vicinity of said predetermined high engine speed criterion, to initiate fuel cut-off operation, said controller driving number of engine cylinders to block fuel delivery based on the excess magnitude of engine speed over said predetermined fuel cut speed for performing fuel cut-off operation for the determined number of engine cylinders and for maintaining fuel injection for remaining cylinders, said controller driving fuel cut-off initiation timing for each of engine cylinders on the basis of said crankshaft angular position and known valve timing of an intake valve for performing said fuel cut-off operation so that fuel cut-off is initiated at a close timing of said intake valve.

20. In a fuel injection system for an internal combustion engine, means for performing a progressive fuel cut-off operation for restricting fuel delivery in response to the engine speed exceeding a predetermined upper value, to prevent the engine from attaining excessively high rotational speed without causing an abrupt change in an output torque of said engine, comprising:

a sensor means for monitoring engine driving condition parameters including a revolution speed of said engine;

a fuel injection system including a controlling means and a fuel injection valve, for delivering a controlled amount of fuel at a controlled timing, said amount and timing being in response to outputs from said sensing: means, said controller responding to the engine evaluation speed being higher than a predetermined fuel cut speed which is set in the vicinity of said predetermined upper value, by causing a progressive fuel cut-off operation to block fuel delivery through said fuel injection valve by an amount corresponding to the magnitude by which said engine rotational speed exceeds said predetermined fuel cut speed, so as to prevent said engine from substantially exceeding said predetermined fuel cut speed without causing an abrupt change in an output torque of said engine.

21. In a fuel injection system for an internal combustion engine, a means for performing a progressive fuel cut-off operation for blocking fuel delivery to a number of cylinders of said engine in response to the engine speed exceeding a predetermined upper value, to prevent the engine from attaining excessively high rotational speed without causing an abrupt change in an output torque of said engine, comprising:

a sensor means for monitoring engine driving condition parameters including a revolution speed of said engine;

said fuel injection system including a controlling means and a plurality of fuel injection valves, said controller responding to the engine revolution speed being higher than a predetermined fuel cut speed which is set in the vicinity of said predetermined upper value by determining which among said plurality of engine cylinders to which fuel delivery is to be blocked, said determined cylinders being progressively larger in number dependent on the excess magnitude of engine speed over said predetermined fuel cut speed, and causing a fuel cut-off operation to block fuel flow to said determined engine cylinders and maintaining fuel injection for remaining cylinders, by controlling fuel flow through a respective number of said fuel injection valves, so as to prevent said engine from substantially exceeding said predetermined fuel cut speed without causing an abrupt change in an output torque of said engine.

22. In a fuel injection system for an internal combustion engine, a method for preventing the engine from attaining excessively high rotational speed without causing an abrupt change in an output torque of said engine, comprising the steps of:

monitoring engine driving condition parameters including a revolution speed of said engine;

delivering a controlled amount of fuel at a controlled timing in response to said monitored condition parameters;

responding to the engine revolution speed being higher than a predetermined fuel cut speed which is set in the vicinity of said predetermined upper value by causing a progressive fuel cut-off operation to block fuel delivery through said fuel injection valve by an amount corresponding to the magnitude by which said engine rotational speed exceeds said predetermined fuel cut speed, so as to prevent said engine from substantially exceeding said predetermined fuel cut speed without causing an abrupt change in an output torque of said engine.

23. In a fuel injection system for an internal combustion engine, a method for preventing the engine from attaining excessively high rotational speed without causing an abrupt change in an output torque of said engine, comprising the steps of:

monitoring engine driving condition parameters including a revolution speed of said engine;

delivering a controlled amount of fuel at a controlled timing in response to said monitored condition parameters;

responding to the engine revolution speed being higher than a predetermined fuel cut speed which is set in the vicinity of said predetermined upper value by determining which among said plurality of engine cylinders to which fuel delivery is to be blocked, said determined cylinders being progressively larger in number dependant on the excess magnitude of engine speed over said predetermined fuel cut speed; and blocking fuel flow to said determined engine cylinders and maintaining fuel injection for remaining cylinders, so as to prevent said engine from substantially exceeding said predetermined fuel cut speed without causing an abrupt change in an output torque of said engine.

* * * * *